US006145354A

United States Patent [19]

Kondo et al.

[11] Patent Number: 6,145,354

[45] Date of Patent: Nov. 14, 2000

[54] DOOR LOCK SYSTEM

[75] Inventors: Ichiro Kondo, Okazaki; Hiroshi Ishihara, Toyoaki; Toshitsugu Oda, Okazaki, all of Japan

[73] Assignee: Aisin Seiki Kabushiki Kaisha, Kariya, Japan

[21] Appl. No.: 09/310,736

[22] Filed: May 13, 1999

[30] Foreign Application Priority Data

May 13, 1998 [JP] Japan ..... 10-130127

[51] Int. Cl.[7] ..... E05B 47/00

[52] U.S. Cl. ..... 70/279.1; 70/264; 292/201; 292/216; 292/DIG. 23

[58] Field of Search ..... 70/279.1, 264, 70/237; 292/201, 216, DIG. 23, DIG. 27

[56] References Cited

U.S. PATENT DOCUMENTS

| | | | |
|---|---|---|---|
| 4,762,348 | 8/1988 | Matsumoto | 292/201 |
| 4,843,849 | 7/1989 | Kamke et al. | 70/264 |
| 4,927,204 | 5/1990 | Asada | 292/216 |
| 4,986,579 | 1/1991 | Ishikawa | 292/201 |
| 5,409,277 | 4/1995 | Rogers, Jr. et al. | 292/336.3 |
| 5,680,783 | 10/1997 | Kuroda | 70/277 |
| 5,769,468 | 6/1998 | Armbruster | 292/201 |
| 5,938,251 | 8/1999 | Watanabe | 292/201 |

FOREIGN PATENT DOCUMENTS

| | | |
|---|---|---|
| 6-288131 | 10/1994 | Japan . |
| 7-217288 | 8/1995 | Japan . |
| 2289715 | 11/1995 | United Kingdom . |

*Primary Examiner*—B. Dayoan
*Assistant Examiner*—Clifford B. Vaterlaus
*Attorney, Agent, or Firm*—Burns, Doane, Swecker & Mathis, LLP

[57] ABSTRACT

A door lock system has a closing mechanism for bringing an ajar condition of a door into a fully closed condition. The fully closed condition of the door is locked for the sake of safety by the locking operation of a locking-and-unlocking mechanism. The locked condition of the door is released by an unlocking operation of the locking-and-unlocking mechanism. Moreover, by actuating a double lock mechanism, the door under the locked condition is further brought into a double-looked condition under which the unlocking operation of the locking-and-unlocking mechanism cannot be established. The closing mechanism, the locking and-unlocking mechanism, and the double lock mechanism are driven by a common electric motor thus allowing the door lock mechanism to be reduced in size and manufactured less expensively.

6 Claims, 12 Drawing Sheets

DOOR LOCK SYSTEM

This application is based on and claims priority under 35 U.S.C. §119 with respect to Japanese Application No. 10(1998)-130127 filed on May 13, 1998, the entire content of which is incorporated herein by reference.

FIELD OF THE INVENTION

The present invention generally relates to a door lock system. More particularly, the present invention pertains to a door lock system for a vehicle that includes a closing mechanism for establishing the fully latched condition of the door from its half latched condition, a locking-and-unlocking mechanism for locking and unlocking the door when the door is in the fully latched or closed condition, and a double locking mechanism for preventing opening of the door when the door is in the locked and fully latched condition.

BACKGROUND OF THE INVENTION

A known door lock system is disclosed in Japanese Patent Laid-Open Publication No. Hei 6(1994)-288131, published without examination. This door lock system includes a locking-and-unlocking mechanism and a closing mechanism which are driven by respective electric motors.

Another known door lock system is disclosed in Japanese Patent Laid-Open Publication No. Hei 7 (1995)-217288, published without examination. This door lock system includes a locking-and-unlocking mechanism and a double lock mechanism which are driven by respective electric motors.

If one were to develop, based on a combination of the systems described in the two documents mentioned above, a door lock system having a closing mechanism, a locking-and unlocking mechanism, and a double lock mechanism, the system would require a total of three electric motors. However, such a system would be rather heavy, excessively large in size, and expensive to manufacture.

In light of the foregoing, a need exists for a door lock system possessing features similar to those described above, but which is smaller, less expensive, and lighter than would otherwise be required.

SUMMARY OF THE INVENTION

According to an aspect of the present invention, a door lock system includes a closing mechanism for bringing a door from its half latched condition to fully latched condition, a locking-and-unlocking mechanism for bringing the door into a locked condition from an unlocked condition and vice-versa subject to the door being in the fully latched condition, and a double lock mechanism for disabling opening of the door and/or an unlocking operation of the locking-and unlocking mechanism. A common motor is adapted to drive the closing mechanism the locking-and-unlocking mechanism, and the double lock mechanism.

BRIEF DESCRIPTION OF THE DRAWING FIGURES

Additional features and characteristics of the present invention will become more apparent from the following detailed description considered with reference to the accompanying drawing figures in which like elements are designated by like reference numerals and wherein.

DETAILED DESCRIPTION OF THE INVENTION

Figure 1:
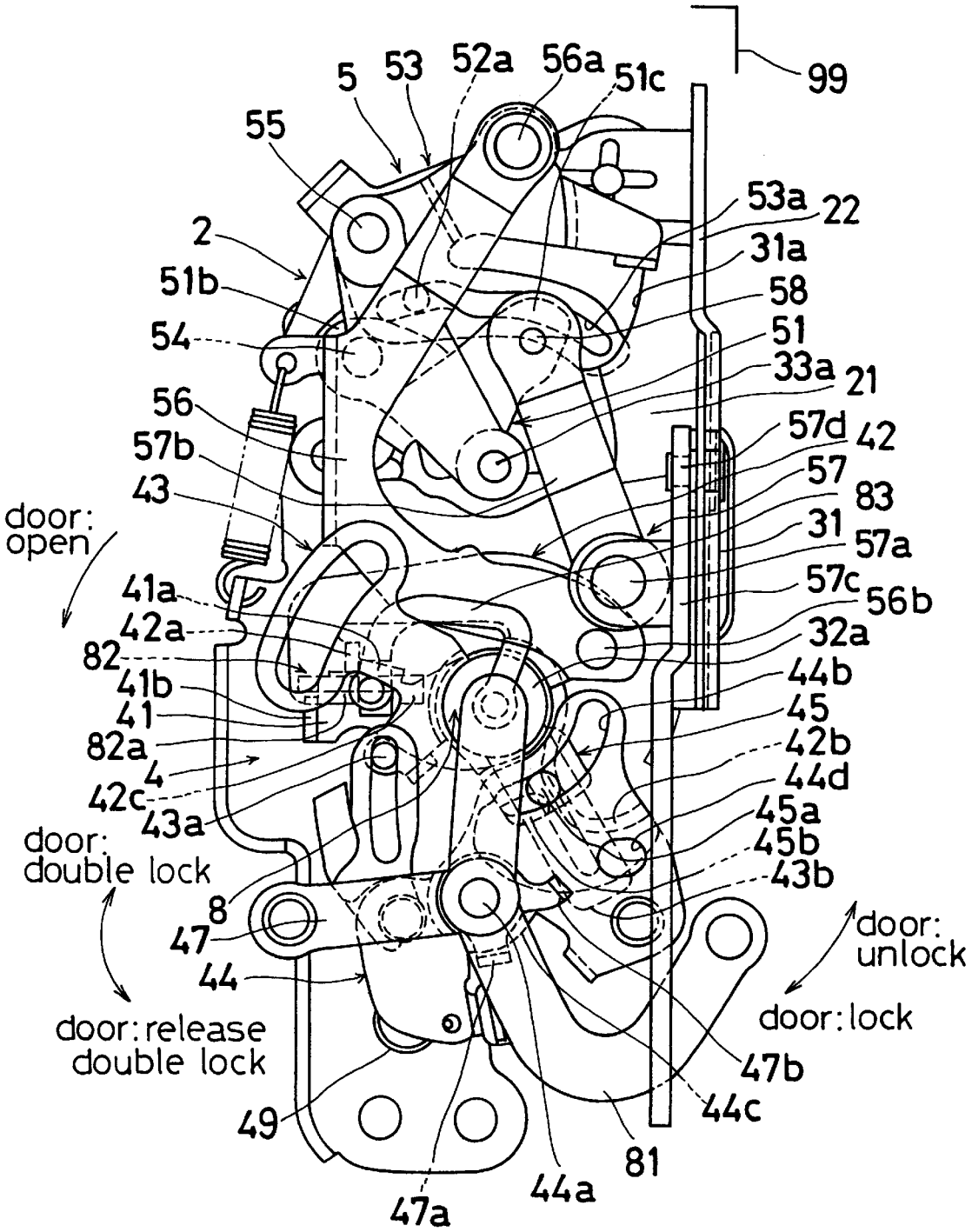
FIG. 1 is a front view of a door lock system in accordance with an embodiment of present invention.
Figure 2:
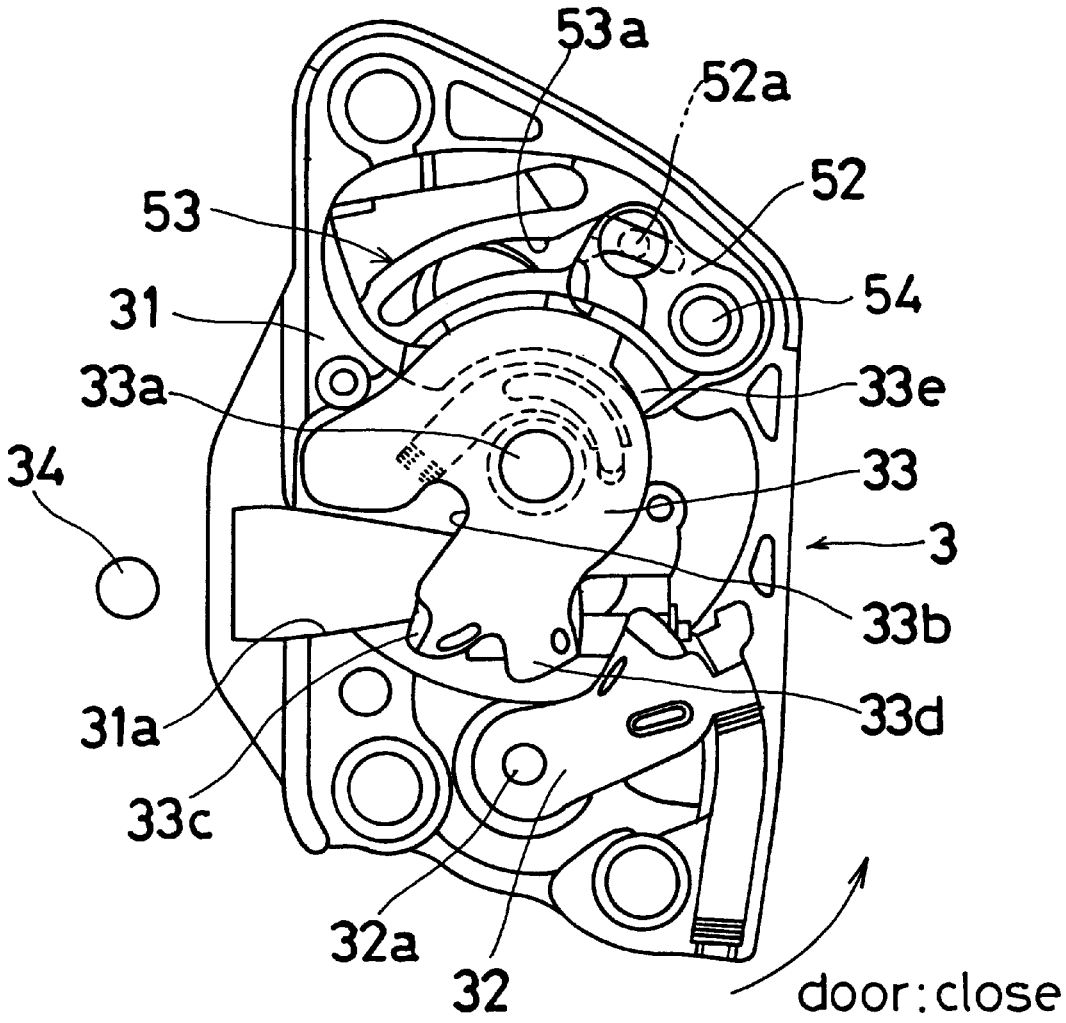
FIG. 2 is a front view of the latch mechanism used in the door lock system shown in FIG 1.
Figure 3:
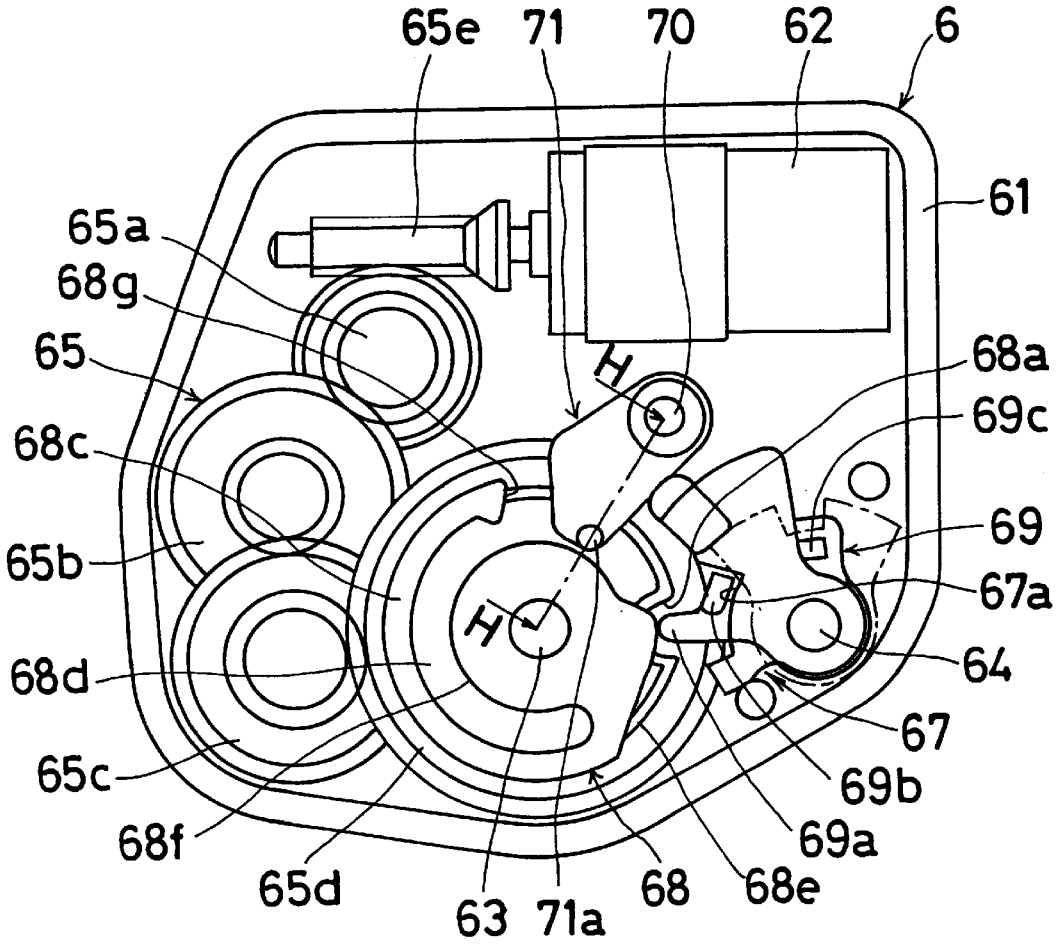
FIG. 3 is a front view of the actuator used in the door lock system shown in FIG. 1.

Referring initially to FIGS. 1–3, the door lock system 1 according to the present invention is adapted to be mounted in a vehicle door 99. The door lock system 1 includes a base plate 2, a latch mechanism 3, a lever mechanism 4, a closing mechanism 5, an actuator 6, and a double lock mechanism 8.

As can be seen from FIG. 1, the base plate 2 is substantially L-shaped in configuration and has a horizontal wall 21 and a vertical wall 22.

As shown in FIG. 2, the latch mechanism 3 includes a pawl 32 and a latch member 33. The pawl 32 and the latch member 33 are accommodated in a body 31 connected to the horizontal wall 21 of the base plate 2. The pawl 32 is connected to the body 31 by a pin 32*a* and the latch member 33 is connected to the body 31 by a pin 33*a*. A groove 31*a* is formed in the body 31 for receiving a striker 34 of a vehicle body whenever the door 99 is closed, with the striker 34 moving out of the groove 31*a* upon opening the door 99.

A U-shaped groove 33*b* is formed in the outer peripheral portion of the latch member 33. This U-shaped groove 33*b* receives the striker 34 when the striker 34 is positioned in the groove 31*a* of the body 31. The outer peripheral portion of the latch member 33 is also provided with first and second pawl portions 33*c*, 33*d* which are adapted to engage the pawl 32. The pawl 32 is brought into engagement, when rotated, with either the first pawl portion 33*c* or the second pawl portion 33*d*. When the striker 34 is being held in the first U-shaped groove 33*b* of the latch member 33, the latch member 33 is prevented, upon engagement between the pawl 32 and the first pawl portion 33*c* of the latch member 33, from being rotated in the counter-clockwise direction, thereby maintaining a fully latched condition of the door 99. On the other hand, with the striker 34 is held in the U-shaped groove 33*d* of the latch member 33, the latch member 33 is prevented, upon engagement between the pawl 32 and the second pawl portion 33*d* of the latch member 33, from being rotated in the counter-clockwise direction, thereby maintaining the door 99 in its half latched condition. Rotating the pawl 32 in the clockwise direction releases the engagement of the pawl 32 from the first pawl portion 33*c* and the second pawl portion 33*d* of the latch member 33, thereby enabling an opened condition of the door 99.

As shown in FIG. 1, the lever mechanism 4 includes a first lift lever 41, a second lift lever 42, an opening lever 43, a locking lever 44, and a first slide bush 45. The first lift lever 41 is placed on the horizontal wall 21 of the base plate 2 and is rotatably mounted on the pin 32*a* which supports the pawl 32 of the latch mechanism 3. The first lift lever 41 is provided with a first flange 41*a* and a second flange 41*b*. When the first flange 41*a* of the first lift lever 41 is in engagement with the pawl 32, the first lever 41 begins to rotate together with the pawl 32. Like the first lift lever 41, the second lift lever 42 is rotatably mounted on the pin 32*a*. The opposite ends of the second lift lever 42 are provided with flange portions 42*a*, 42*b*. When the second lift lever 42 is rotated in the counter-clockwise direction in FIG. 1 for opening the door 99, the flange portion 42*a* of the second lift lever 42 is brought into operative engagement with the flange portion 41*b* of the first lift member 41 via a second slide bush 82 of a double lock mechanism 8 as will be described in more detail later, thereby transmitting the rotation of the second lift lever 42 to the first lift lever 41. The second lift lever 42 is also formed with a supporting arm 42*c* which extends from the flange portion 42*a* for supporting the second slide bush 82.

Similar to the first lift lever 41 and the second lift lever 42, the opening lever 43 is placed on the horizontal wall 21 of the base plate 2 and is rotatably mounted on the pin 32*a* which supports the pawl 32 of the latch mechanism 3. One end of the opening lever 43 is coupled, via a link mechanism, to an outside door handle provided at an outer side of the door 99. The opening lever 43 is formed at its one end with a pin portion 43*a*.

The locking lever 44 is mounted on the horizontal wall 21 of the base plate 2 and is pivotally connected to the horizontal wall 21 by a pin 44*a*. The locking lever 44 is operatively connected to a locking knob provided at an interior side of the door 99 by way of a lever portion 64*a* of the actuator 6 as will be described below in more detail and is also connected to a key-cylinder mechanism at an exterior side of the door 99 via a key lock lever 47 as will be discussed below in more detail. The other end of the locking lever 44 is formed with an arcuate slot 44*b* whose rotational center coincides with the center of the pin 32*a*.

A sliding bush 45 is mounted in a slidable manner on the other arm 43*b* of the opening lever 43. The sliding bush 45 is formed with a pin portion 45*a* which is in sliding engagement with the slot 44*b*. Also, the sliding bush 45 is formed with a projection 45*b* which is brought into and out of engagement with the flange portion 42*b* of the second lift lever 42 when the opening lever 43 rotates. The sliding bush 45 having this structure is movable along the other arm 43*b* due to the fact that when the locking lever 44 rotates, the resultant rotation is transmitted to the sliding bush 45 by way of the slot 44*b* and the pin 45*a* fitted in the slot 44*b*. This sliding movement causes the projection 45*b* of the sliding bush 45 to move into or out of engagement with the flange portion 42*b* of the second lift lever 42. Thus, the lever mechanism 4 establishes the locked and unlocked conditions of the door 99. It is to be noted that the locking lever 44 is under the compression force of a turnover spring 49 which is disposed between the locking lever 44 and the base plate 2 for maintaining the locked and unlocked conditions of the door 99.

The key lock lever 47 is mounted on a surface of the horizontal wall 21 of the base plate 2 and is rotatably connected to the horizontal wall 21 by the pin 44*a*. The key lock lever 47 is formed with a projection 47*a* which is in engagement with or is fitted in a notch 44*c* of the locking lever 44. Thus, when the key lock lever 47 rotates, the rotation of the key lock lever 47 is transmitted to the locking lever 44.

As can be seen from FIGS. 1 and 2, the closing mechanism 5 includes a closing lever 51, a release pawl 52, and a cancel lever 53. The closing lever 51, which possesses first and second arm portions 51*b*, 51*c*, is located in a common opening 31*a* of the body 31 and the horizontal wall 21 of the base plate 2, and is rotatably mounted on the pin 33*a* which supports the latch member 33 of the latch mechanism 3.

The release pawl 52 is coplanar with the latch member 33 and is rotatably mounted on the first arm portion 51*b* of the closing lever 51 by a pin 54. The release pawl 52 is driven with a pin 52*a*. A notch 33*e* is formed in the outer periphery of the latch member 33, and this notch 33*e* is engageable with the release pawl 52.

The cancel lever 53 is, in the vicinity of the opening 31*a*, rotatably supported on the horizontal wall 21 of the base plate 2 by a pin 55. The cancel lever 53 is formed with an arcuate slot 53*a* with which the pin 52*a* of the release pawl 52 is in sliding engagement. Thus, when the cancel lever 53 is rotated, the resultant rotation is transmitted via the slot 53*a* and the pin 52*a* to the release pawl 52, and this causes the pawl portion 33*e* of the latch member 33 to move into and out of engagement with the release pawl 52. The cancel lever 53 is connected to the second lift lever 42 via a rod 56 and is also coupled to an inside handle which is attached to the interior side of the door 99 via an inside lever which is rotatably supported on the vertical wall 22 of the base plate 2. The rod 56 is pivoted to the cancel lever 53 by a pin 56*a* and is also pivoted to the second lift lever 42 by a pin 56*b*. The close lever 51 is coupled at its second arm portion 51*c* to a closing-output lever 66 of the actuator 6 via a rod 57.

Figure 4:
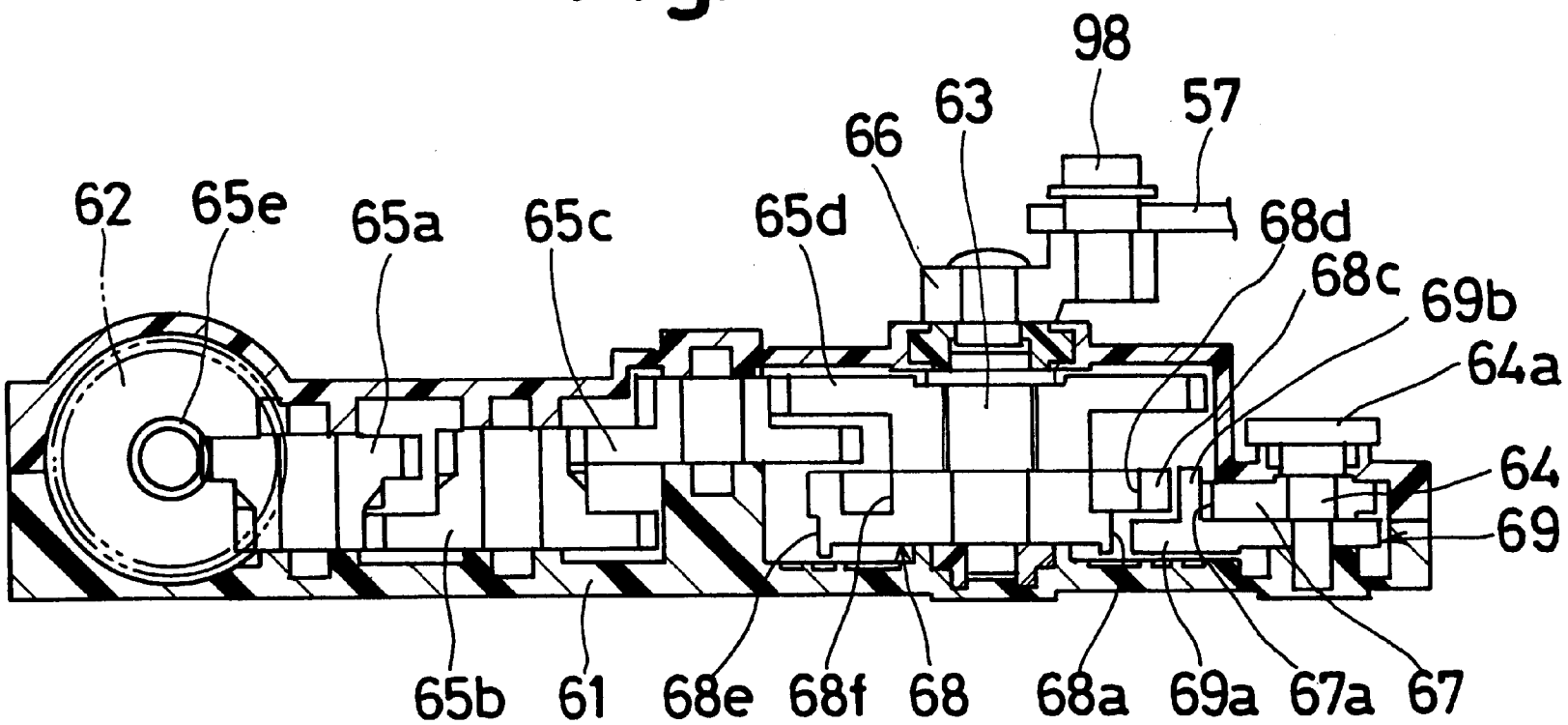
FIG. 4 is a horizontal cross-sectional view of the actuator depicted in FIG. 3.
Figure 5:
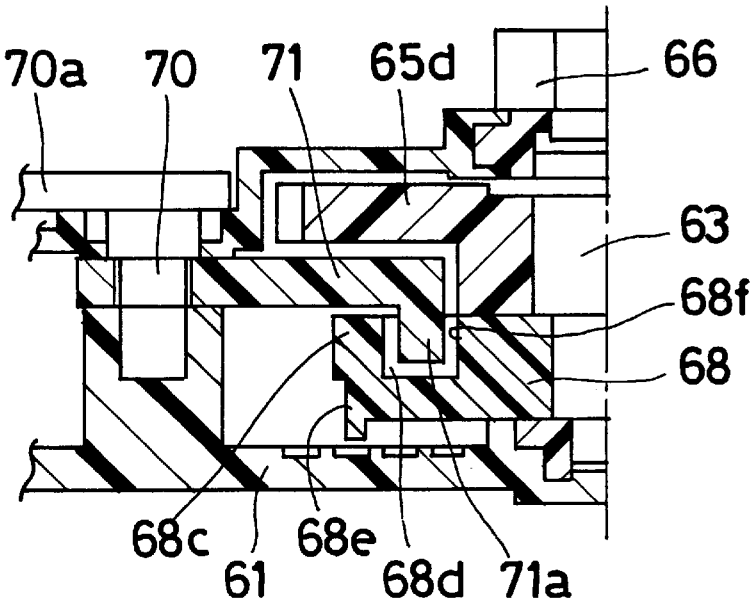
FIG. 5 is a cross-sectional view of the actuator taken along the section line V—V in FIG. 3.

The rod 57 is a two-part configuration having a first rod 57*b* and a second rod 57*c* connected by the pin 57*a*. The first rod 57*b* is pivoted by a pin 58 to the second arm portion 51*c*. One end of the second rod 57*c* is in sliding engagement with the vertical wall 22 of the base plate 2 by means of a pin 57*d*. The other end of the second rod 57*c* is pivoted to the closing output lever 66 of the actuator 6 via a pin 98 as seen in FIG. 4.

As shown in FIG. 1, the double lock mechanism 8 includes a double lock lever 81 and the second slide bush 82. The double lock lever 81 is mounted on the surface of the horizontal wall 21 of the base plate 2 and is rotatably supported on the horizontal wall 21 by the pin 44*a* which supports the locking lever 44 and the key lock lever 47.

The second slide bush 82 is slidably mounted on the supporting arm 42*c* of the second lift lever 42 and is connected via a link 83 to one end of the double lock lever 81. The second slide bush 82 is formed with an engaging wall 82*a* with which the flange 41*b* of the first lift lever 41 engages when the second lift lever 42 rotates. The second slide bush 82 constructed in this manner is thus brought into sliding movement relative to the supporting arm 42*c* of the second lift lever 42 by receiving a force via the link 83 from the double lock lever 81 when the double lock lever 81 is rotated. This movement of the second slide bush 82 relative to the supporting arm 42*c* causes the engaging wall 82*a* to move into and out of engagement with the flange portion 41*b* of the first lift lever 41. Thus, the double lock mechanism 8 brings a double locked condition under which opening of the door 99 is disabled and a double lock released condition under which opening of the door 99 is enabled.

The key lock lever 47 is provided with an engaging arm portion 47*b* which forms an extension of the key lock lever 47 and is brought into engagement with the double lock lever 81 upon rotation of the key lock lever 47. This means that rotation of the key lock lever 47 brings about rotation of the double lock lever 81 which transfers the door 99 to its double lock release condition from the double locked condition.

Referring now to FIGS. 3–6, the actuator 6 includes a single reversible motor 62 which is adapted to rotate in either direction. The motor 62 is accommodated in a housing 61 and is also supported by the vertical wall 22 of the base plate 2. The actuator 6 includes first, second, and third output shafts 63, 64, 70 which pass through and extend outside the housing 61. The first output shaft 63 is coupled to the motor 62 via a speed reduction gear train 65 defined by a plurality of gears 65*a*, 65*b*, 65*c*, 65*d*, and a worm gear 65*e* fixed on a shaft of the motor 62 as seen in FIGS. 3 and 4. A closing output lever 66 located outside the housing 61 is fixedly mounted on the extremity of the first output shaft 63 for unitary rotation with the first output shaft 63.

The second output shaft 64 is secured with a locking-and-unlocking output lever 67 for unitary rotation. The third output shaft 70 is also secured with a double locking output lever 71 for unitary rotation. The closing output lever 66 is arranged to reciprocate between its initial position A and an operation position B as will be described below in more detail. The closing output lever 66 is connected via the rod 57 to the second arm portion 51*c* of the close lever 51. When the closing output lever 66 rotates, the rod 57 is brought into sliding movement along the vertical wall 22 of the base plate 2 by continual guidance of the vertical wall 22, thereby rotating the close lever 51. The locking-and-unlocking lever 67 is set to be movable in reciprocation between its locking position C and unlocking position D as will be explained in more detail below.

The second output shaft 64 to which the locking-and-unlocking lever 67 is connected within the housing 61 is connected to the locking lever 44 in such a manner that a lever portion 64*a* of the second output shaft 64 located outside the housing 61 is fitted into an aperture 44*d* (which is shown in FIG. 1) of the locking lever 44. As a result, when the locking-and-unlocking output lever 67 is brought into swinging movement, the locking lever 44 is rotated.

The double lock output lever 71 is adapted to be movable between a maintain position E and a release position F. The double lock output lever 71 is operatively connected to the other arm portion of the double lock lever 81 via a lever portion 70*a* of the third output shaft 70 which is located outside the housing 61 and a link mechanism. Thus, swinging movement of the double lock output lever 71 rotates the double lock lever 81.

A cam 68 is formed integrally with the gear 65*d* which is fixed on the first output shaft 63 so as to be rotated therewith. A concave groove 68*a* is formed in the outer periphery of the cam 68 and extends over one-half of the cam 68 with respect to the thickness direction of the cam 68 (i.e., the lower left portion of the cam 68 in FIG. 4). An operation lever 69 is supported by the second output shaft 64 such that relative swinging movement between the operation lever 69 and the second output shaft 64 is possible. A projecting pin portion 69*a* is provided at the distal end of the operation lever 69. This pin portion or projection 69*a* is adapted to move into and out of engagement with the groove 68*a* of the cam 68. So long as the pin portion 69*a* is in engagement with the groove 68*a* of the cam 68, the operation lever 69 is brought into swinging movement when the cam 68 rotates. Also, the operation lever 69 is provided with a projection 69*b* which is received in a notch 67*a* formed in the locking-and-unlocking lever 67, thereby transmitting the swinging movement of the operation lever 69 to the locking-and-unlocking lever 67.

The outer periphery 68*f* of the cam 68 is provided with a first cam profile 68*b* possessing a somewhat projecting configuration. The first cam profile 68*b* is disposed over half the axial thickness of the outer periphery 68*f* of the cam 68. Along the outer periphery 68*f* of the cam 68 extends an arm portion 68*c* which is continuous with and extends from the first cam profile 68*b* such that a groove 68*d* is defined between the outer periphery 68*f* and the arm portion 68*c*. A second cam profile 68*g* is provided at the distal end of the arm portion 68*c*. A driven pin 71*a* is located at the distal end of the double lock output lever 71. The pin 71*a* opposes the first cam profile 68*b* so as to be engageable with the first cam profile 68*b* when the double lock output lever 71 is at the remaining position E. The pin 71*a* is positioned in the groove 68*d* and opposes the second cam profile 68*g* so as to be engageable with the second cam profile 68*g*.

A spring 73 is wound around the second output shaft 64. Both ends of the spring 73 are in engagement with a common projection 61*b* formed at an inner periphery of the opening 61*a* of the housing 61. A projection 69*c* is positioned on the operation lever 69 between the ends of the spring. Thus, the spring 73 urges the operation lever 69 such that when the spring 73 is deformed by the swinging movement of the operation lever 69, the projection or pin portion 69*a* of the operating lever 69 is brought into continual contact with the cam 68 and the spring urges the operation lever 69 to return to its neutral position C relative to the locking-and-unlocking lever 71.

A turnover spring 74 is interposed between the double lock output lever 71 and the housing 61 to maintain the instant position of the double lock output lever 71 whenever the double lock output lever 71 is transferred to either the maintaining position E or the releasing position F.

It is to be noted that the lever portion 64*a* of the second output shaft 64 rotatable together with the locking-and unlocking output lever 67 is operatively connected to the lock knob via a cable (not shown).

Having described the various features and characteristics of the door lock system, the operation of the system will be described.

Locking-and-Unlocking Operation Mode

Figure 6:
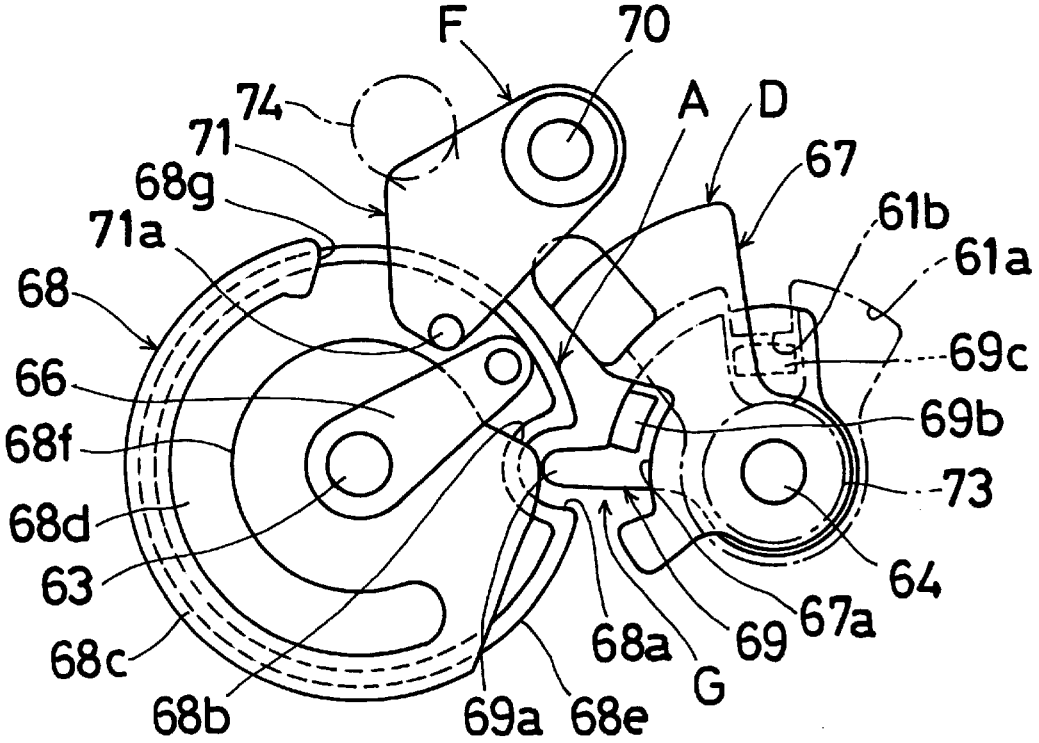
FIG. 6 is a plan view of the actuator shown in FIG. 3 illustrating an initial condition of the actuator.

As shown in FIGS. 1 and 6, while the door 99 is in the unlocked condition, the locking and-unlocking output lever 67 is at the unlocked position D, and the operation lever 69 is at the neutral position G under which the pin 69*a* is located in the concave groove 68*a* in the cam 68. Even though the door 99 is in the unlocked condition, the double lock output lever 71 is at the releasing position F and the pin 71*a* is engageable with the first cam profile 68*b*. It is noted that under such a condition, the close output lever 66 is at the initial position A.

Figure 7:
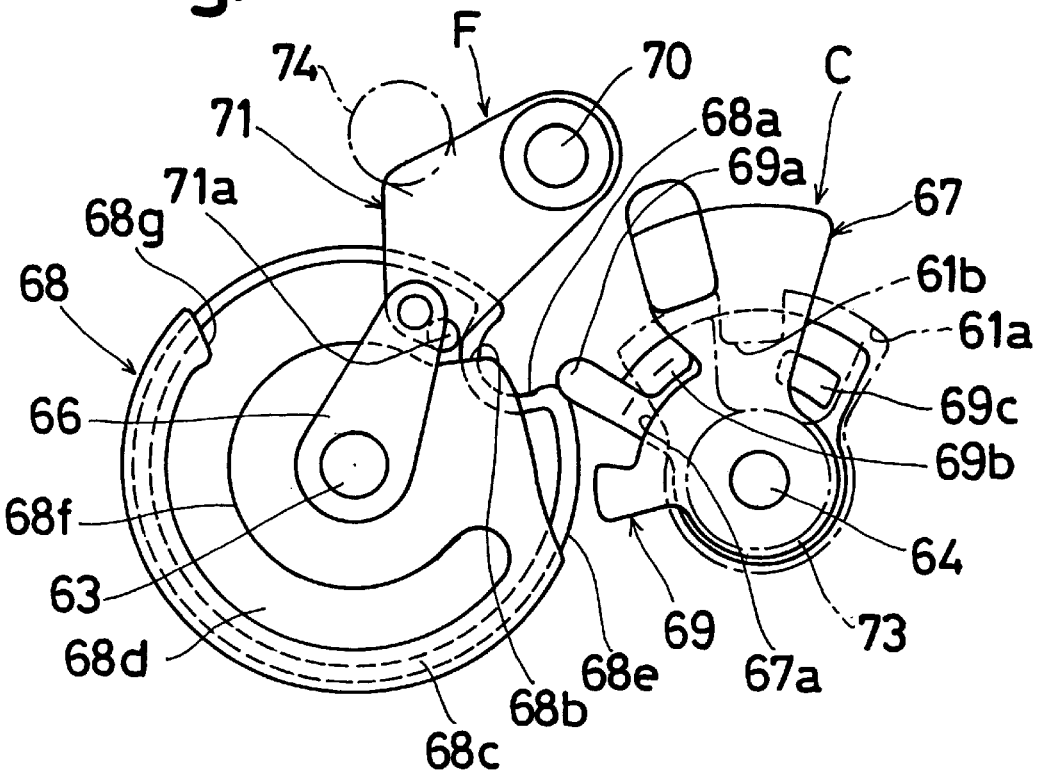
FIG. 7 is a plan view of the actuator illustrating a locking operation of the door lock system.

Under this condition, when the motor 62 of the actuator 6 is turned on to operate in a first direction, the resultant rotation is transmitted via the speed reduction gear train 65 to the cam 68, which rotates the cam 68 through an angle in the counter-clockwise direction in FIG. 6 of about 35 degrees as measured from the neutral position G of the operation lever 69. This establishes an engagement of the pin portion 69*a* of the operation lever 69 with the wall of the concave groove 68*a* of the cam 68, thereby rotating the operation lever 69 from its neutral position in the clockwise direction in FIG. 6. Further, when the projection 69*b* of the operation lever 69 is brought into contact with a side wall of the notch 67*a* of the locking and-unlocking output lever 67, the locking-and-unlocking output lever 67 is rotated in the clockwise direction in FIG. 6 which indicates the door locking direction. This results in the locking-and-unlocking output lever 67 being transferred to its locked position C as shown in FIG. 7. Thus, the locking lever 44 is rotated in the clockwise direction (door locking direction) in FIG. 1, with the resultant position of the locking lever 44 being held as its is by the turn over spring 49, and the lever mechanism 4 places the door 99 in its locked condition. Thereafter, when the motor 62 is driven in a second direction opposite the first direction, as can be seen from FIG. 8, the operation lever 69 is returned to its neutral position G and the pin 69*a* of the operation lever 69 is brought into position in the concave groove 68*a* of the cam 68. Due to the fact that the locking-and-unlocking output lever 67 is urged by the turn over spring 49 via the locking lever 44, the locking-and-unlocking output lever 67 fails to follow the return rotation of the operation lever 69, which results in the locking-and-unlocking output lever 67 remaining at its locked position C.

Figure 8:
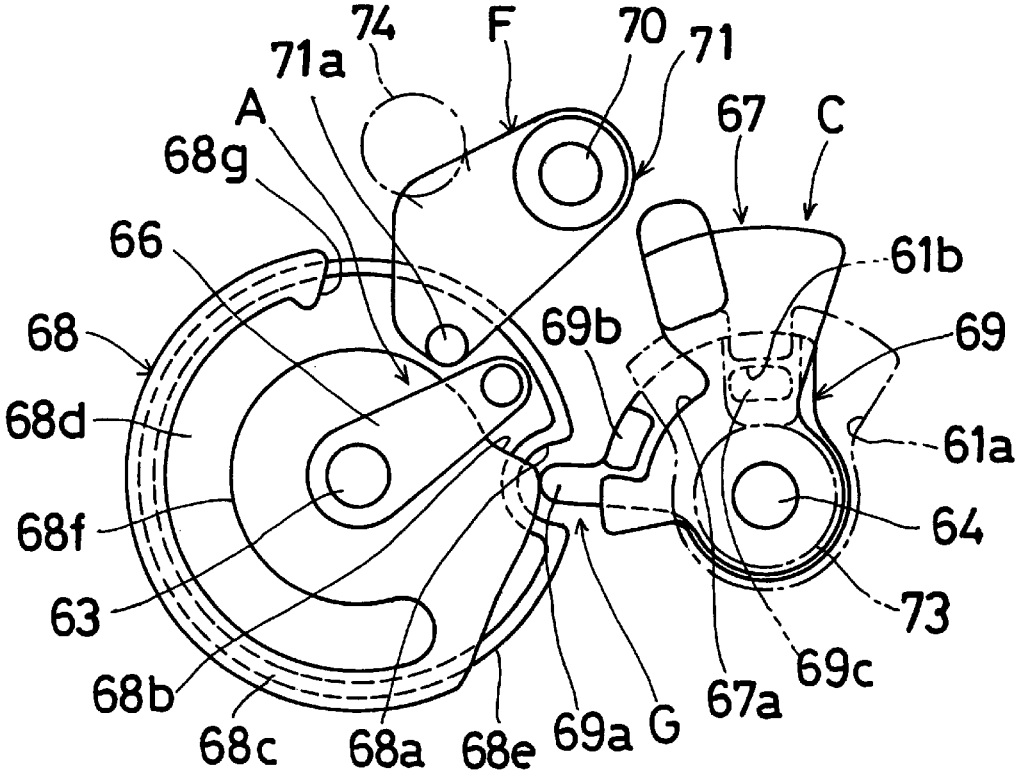
FIG. 8 is a plan view of the actuator also illustrating a locking operation of the door lock system.
Figure 9:
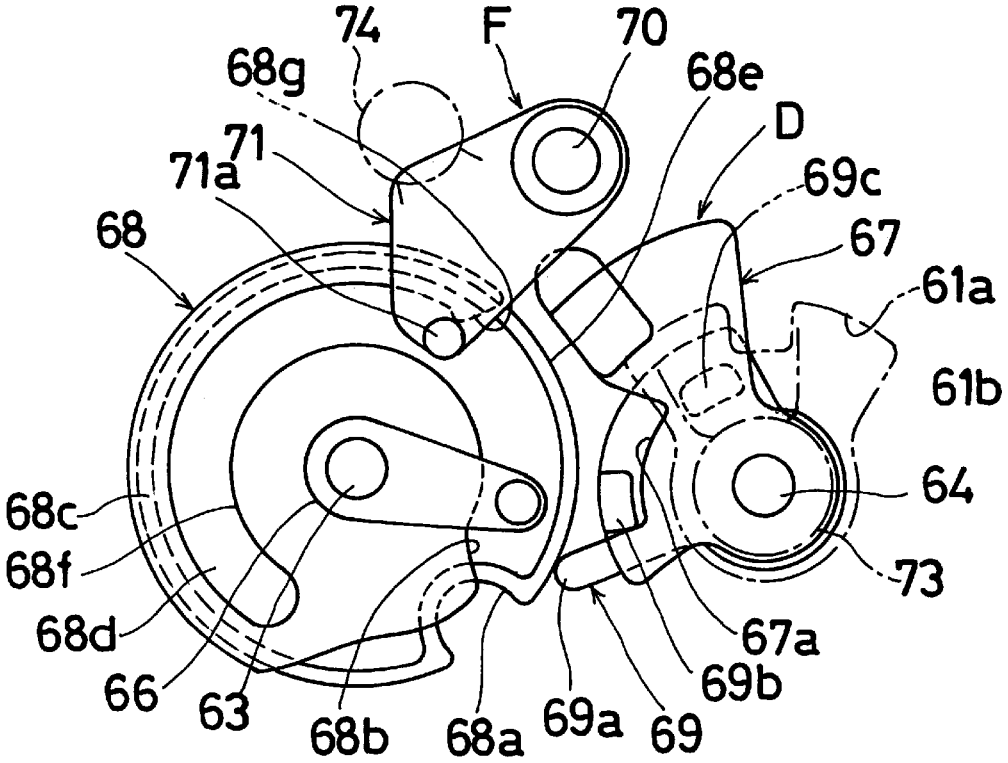
FIG. 9 is a plan view of the actuator illustrating an unlocking operation of the door lock system.

Under the condition that the door 99 is in its locked condition, when the motor 62 is turned on in the second direction, the resultant rotation is transmitted via the speed reduction gear train 65 to the cam 68, which rotates the cam 68 through an angle in the clockwise direction in FIG. 8 of about 50 degrees measured from the neutral position G of the operation lever 69. This establishes an engagement of the pin portion 69*a* of the operation lever 69 with the wall of the concave groove 68*a* of the cam 68, thereby rotating the operation lever 69 from its neutral position in the counter-clockwise direction in FIG. 8. Further, when the projection 69*b* of the operation lever 69 is brought into contact with the side wall of the notch 67*b* of the locking-and-unlocking output lever 67, the locking-and-unlocking output lever 67 is rotated in the counter clockwise direction in FIG. 8 which indicates the door unlocking direction. This results in the locking-and-unlocking output lever 67 being transferred to its unlocked position D as shown in FIG. 9. Thus, the locking lever 44 is rotated in the counter-clockwise direction (door unlocking direction) in FIG. 1, the resultant position of the locking lever 44 is held as it is by the turn over spring 49, and the lever mechanism 4 brings the door 99 to its unlocked condition. Thereafter, when the motor 62 is driven back in the first direction, as can be seen from FIG. 6, the operation lever 69 is returned to its neutral position G. Due to the fact that the locking and-unlocking output lever 67 is urged by the turn over spring 49 via the locking lever 44, the locking-and-unlocking output lever 67 fails to follow the return rotation of the operation lever 69, and this results in the locking-and-unlocking output lever 67 remaining at its unlocked position D.

The transfer of the door 99 from its unlocked condition to its locked condition and vice-versa can be established by operating the lock knob manually which rotates the locking-and-unlocking output lever 67 via the cable in the door locking direction and the door unlocking direction, respectively.

The transfer of the door 99 from its unlocked condition to its locked condition and vice-versa can also be established by operating the key-cylinder mechanism such that the key lock lever 47 is rotated. This results in the locking-and-unlocking output lever 67 being rotated in the door locking direction and the door unlocking direction, respectively. It is to be noted that although the locking-and-unlocking output lever 67 is rotated by the locking lever 44, positioning the operation lever 69 at its neutral position G fails to prevent the rotation of the locking-and-unlocking output lover 67, thereby ensuring the rotation of the locking lever 44 in a smooth manner.

Door Double Lock

When one or more passengers get out of the vehicle so that no passengers remain, the door 99 is brought into the locked condition, and for the sake of anti-theft, the door 99 is brought into an additional or a double-locked condition. In this condition, even though any one of the locking knob, the inside handle or the outside handle is manipulated, the door 99 remains in its locked condition or the door 99 is prevented from being opened compulsorily.

Figure 10:
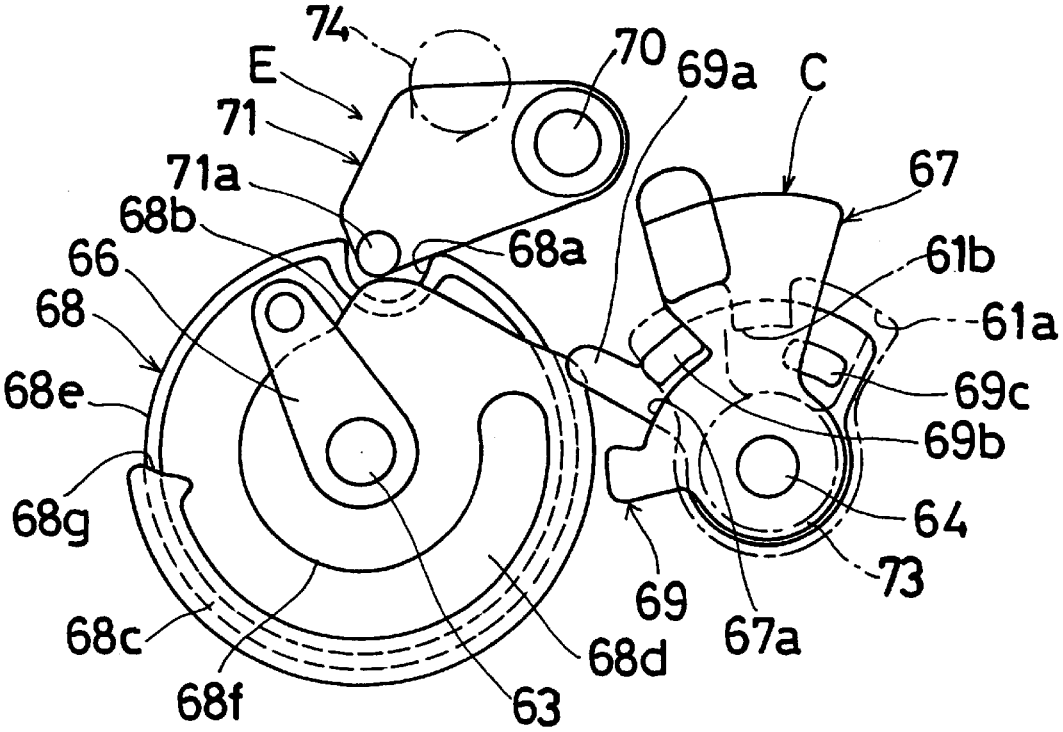
FIG. 10 is a plan view of the actuator illustrating a double-locking operation of the door lock system.

In the condition depicted in FIG. 6, when the motor 62 is turned on in the first direction, the resultant rotation is transmitted via the speed reduction gear train 65 to the cam 68, which rotates the cam 68 through an angle in the counter-clockwise direction in FIG. 6 of about 85 degrees as measured from the neutral position G of the operation lever 69. This establishes an engagement of the first cam profile 68*b* of the cam 68 with the pin 71*a* of the double lock output lever 71, thereby applying an urging force to the pin 71*a*. The double lock output lever 71 is then rotated in the clockwise direction in FIG. 6 from its releasing position F to its maintaining position E as shown in FIG. 10. The resulting position of the double lock output lever 71 is held by the turnover spring 74. Thus, the double lock lever 81 is rotated in the clockwise direction or door double locking direction in FIG. 1. This results in the double lock mechanism 8 causing the door 99 to be in its double locked condition. Thereafter, when the motor 62 is driven in the second or opposite direction, as can be seen from FIG. 11 the cam 68 is returned to its neutral position G defined by the operation lever 69. Due to the fact that the double locking output lever 71 is urged by the turn over spring 74, the double locking output lever 71 does not follow the return rotation of the operation lever 69, which results in the double locking output lever 71 remaining at its maintaining position E.

Figure 11:
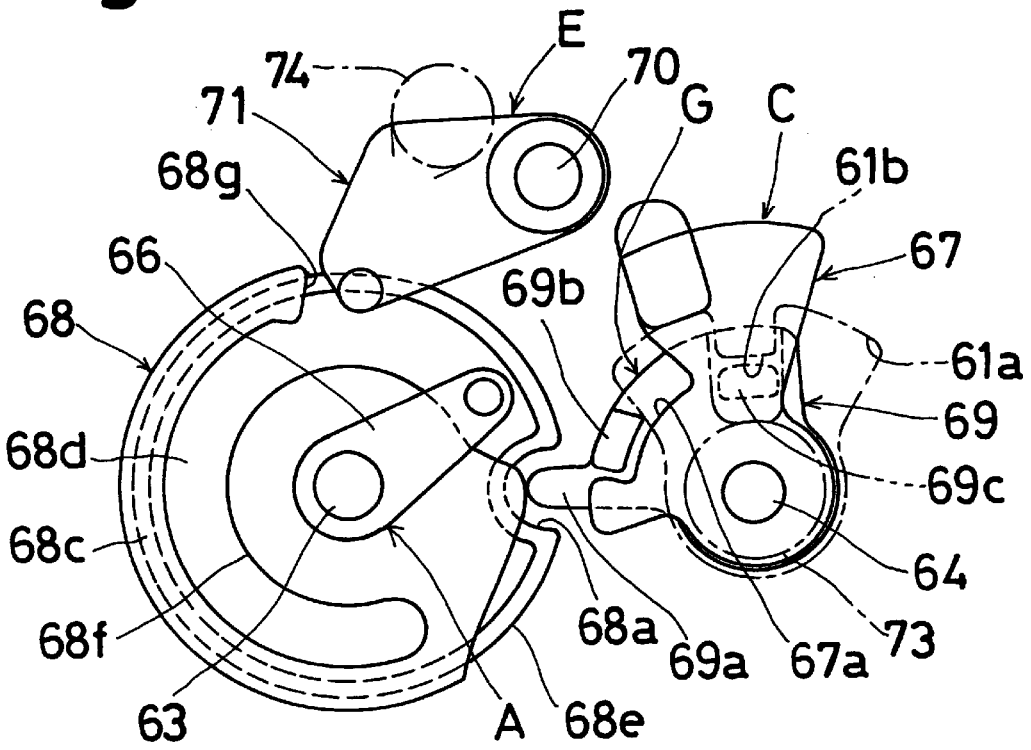
FIG. 11 is a plan view of the actuator also illustrating a double-locking operation of the door lock system.
Figure 12:
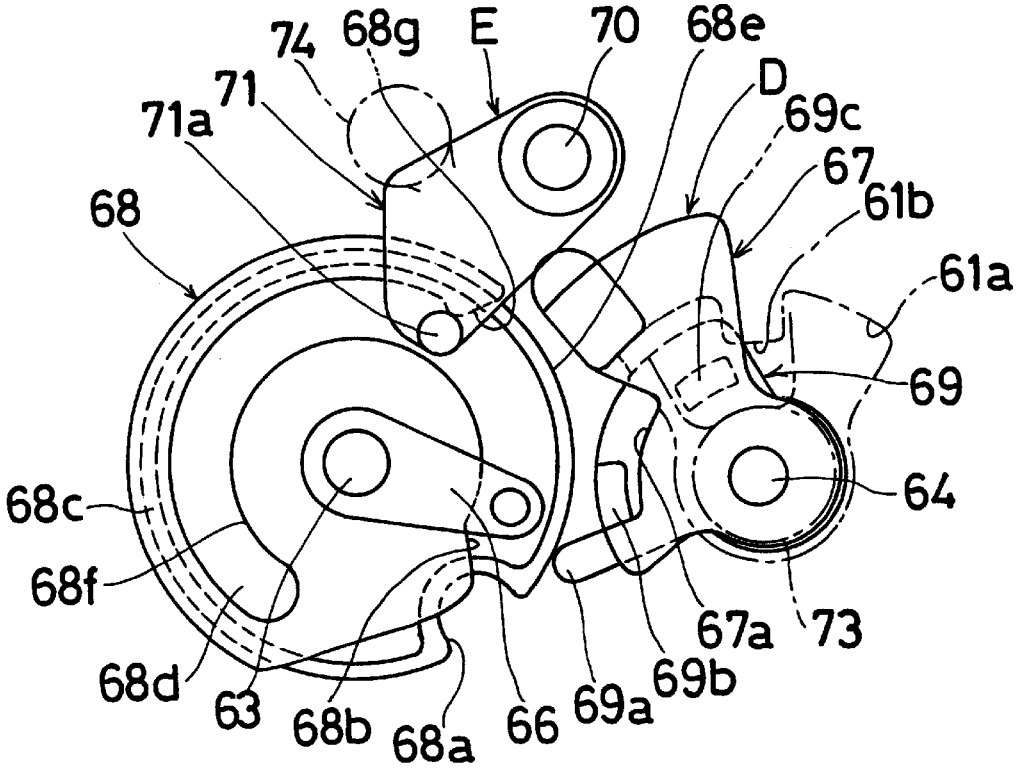
FIG. 12 is a plan view of the actuator illustrating the release of the double-locked condition of the door lock system.

From the condition depicted in FIG. 11, when the motor 62 is turned on in the second direction, the resultant rotation is transmitted via the speed reduction gear train 65 to the cam 68, which rotates the cam 68 through an angle in the clockwise direction in FIG. 11 of about 50 degrees measured from the neutral position G of the operation lever 69. This establishes an engagement of the second cam profile 68*g* of the cam 68 with the pin 71*a* of the double lock output lever 71, thereby urging the pin 71*a*. The double lock output lever 71 is then rotated in the counter-clockwise direction in FIG. 11 from its maintaining position E to its releasing position F and as shown in FIG. 12 the resulting position of the double lock output lever 71 is held by the turnover spring 74. Thus, the double lock lever 81 is rotated in the counter-clockwise direction or door double lock releasing direction in FIG. 1.

This results in the double lock mechanism 8 releasing the door 99 from its double locked condition. Thereafter, when the motor 62 is driven in the first direction, as can be seen from FIG. 6, the cam 68 is returned to its neutral position G defined by the operation lever 69. Due to the fact that the double locking output lever 71 is urged by the turn over spring 74, the double locking output lever 71 does not follow the return rotation of the operation lever 69, and this results in the double locking output lever 71 remaining at its releasing position F.

In the event of a malfunction of the motor 62, the double locked condition of the door 99 can be released in a compulsory manner to the locked condition by manipulating the key-cylinder mechanism. When the key lock lever 47 is rotated in the door unlocking direction by manipulating the key-cylinder mechanism, rotation of the locking lever 44 in the door unlocking direction and rotation of the double lock lever 81 being engaged with the arm 47*b* of the key lock lever 47 in the door double lock releasing direction are established concurrently. Thus, the door 99 is brought into its locked condition after being released from its double locked condition.

Door Opening and Closing

Referring to FIG. 2 which shows the latch mechanism 3 when the door 99 is opened, under this condition, when the door 99 is urged to close, the striker 34 is received in the U-shaped groove 33*b* of the latch member 33, thus causing the latch member 33 to rotate in the counter-clockwise direction or door closing direction in FIG. 2. The first pawl portion 33*c* of the latch member 33 is then brought into engagement with the pawl 32, thereby establishing the fully closed or the full latched condition of the door 99.

While the door 99 is in both the locked condition and the fully latched or closed condition, if the outside handle is manipulated, the open lever 43 is rotated in the counter-clockwise direction or the door opening direction in FIG. 1. This causes an engagement of the projection 45*b* of the first slide bush 45 with the flange 42*b* of the second lift lever 42, resulting in the second lift lever 42 being rotated in the counter-clockwise direction or the door opening direction in FIG. 1. The resulting rotation of the second lift lever 42 establishes an operative engagement of the flange 42*a* of the second lift lever 42 with the flange 41*b* of the first lift lever 41 via the wall 82*a* of the second slide bush 82, thereby rotating the first lift lever 41 in the counter-clockwise direction or the door opening direction in FIG. 1. The pawl 32 of the latch mechanism 3 is released from the first pawl portion 33*c* of the latch member 3, thus bringing the door 99 into its opened condition. Also, upon manipulation of the inside handle, the resultant force is transmitted via the inside lever to the cancel lever 53, thereby rotating the cancel lever 53 in the counter-clockwise direction or the door opening direction in FIG. 1. The resultant rotation of the cancel lever 53 is transmitted via the rod 56 to the second lift lever 42, thereby rotating the second lift lever 42 in the door opening direction. Such rotation of the second lift lever 42 establishes an operative engagement of the flange 42*a* of the second lift lever 42 with the flange 41*b* of the first lift lever 41 via the wall 82*a* of the second slide bush 82, thus causing rotation of the first lift lever 41 in the counter-clockwise direction or the door opening direction in FIG. 1. This brings about a release of the pawl 32 of the latch mechanism 3 from the first pawl portion 33*c* of the latch member 33.

Door Closing

Figure 13:
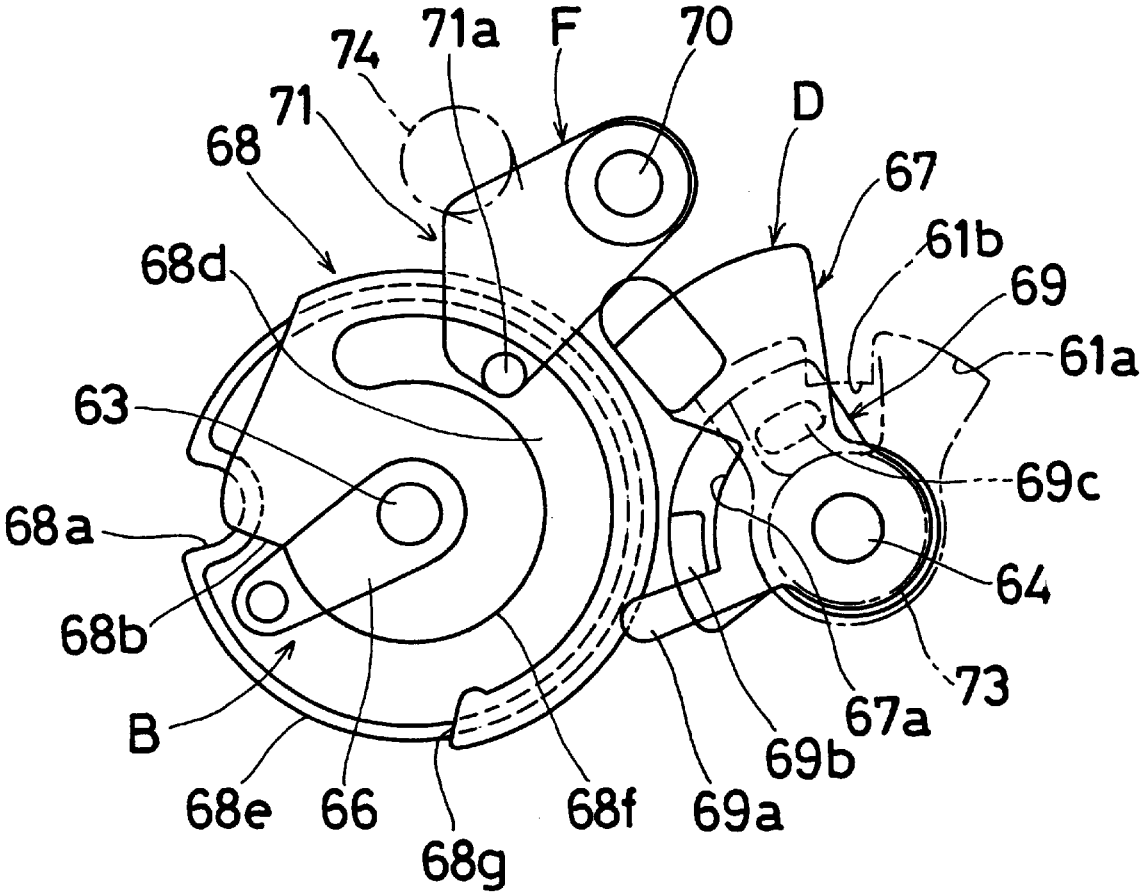
FIG. 13 is a plan view of a portion of the door lock system according to the present invention illustrating the closing operation.
Figure 14:
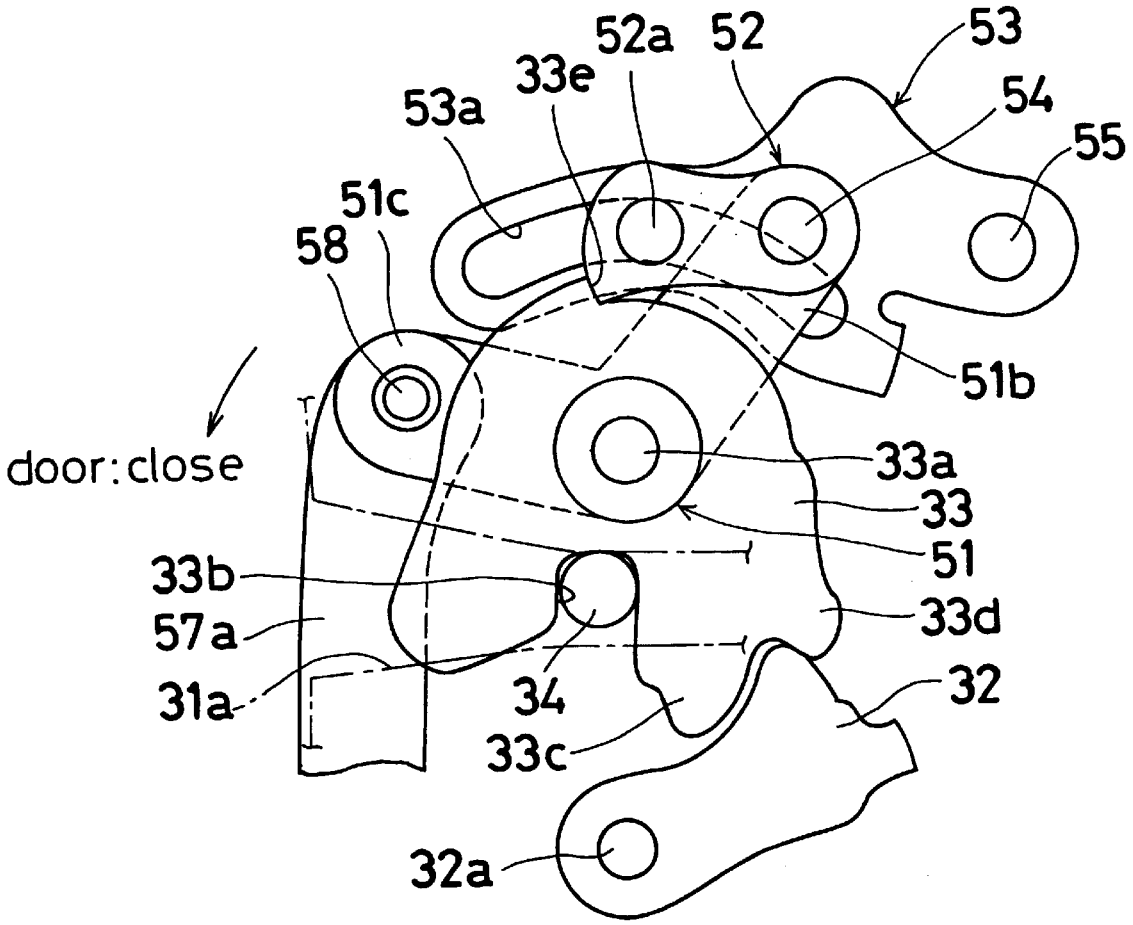
FIG. 14 is a plan view of a portion of the door lock system according to the present invention illustrating the closing operation.
Figure 15:
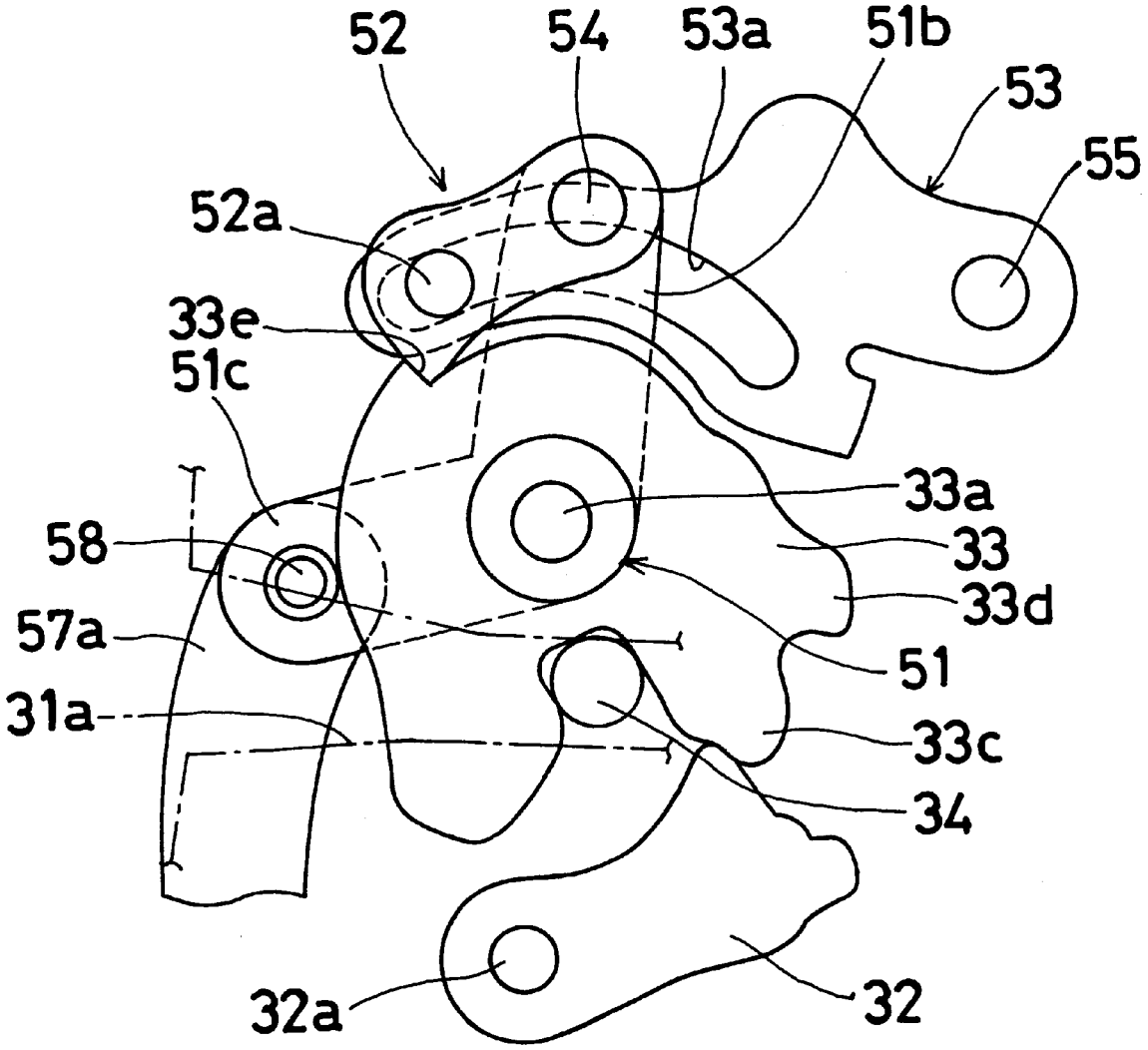
FIG. 15 is a plan view of a portion of the door lock system according to the present invention also illustrating the closing operation.

When it is desired to close the door 99, if an urging force applied to the door 99 is insufficient, the half-latched condition or the door ajar condition occurs under which the an engagement of the first pawl portion 33*c* of the latch member 33 with the pawl 32 is not completed, but the second pawl portion 33*d* of the latch member 33 is in engagement with the pawl 32. When the motor 62 is driven in the second direction in FIG. 6, the resultant rotation is transmitted via the speed reduction gear train 65 to the cam 68 and the close output lever 66, resulting in the output lever 66 being rotated in the clockwise direction through an angle of about 180 degrees starting from the neutral position G defined by the operation lever 69. The close output lever 66 is thus rotated from its initial position A to its operation position B as shown in FIG. 13. Then, as can be seen from FIG. 14, the resulting rotation of the output lever 66 is transmitted via the rod 57 to the close lever 51, thereby rotating the close lever 51 in the counter-clockwise direction or the door closing direction in FIG. 14. Thus, the release pawl 52 is, after being guided along the slot 53*a* in the cancel lever 53, brought into engagement with the pawl portion 33*e* of the latch member 33. Thereafter, the latch member 33 is rotated in the door closing direction by the release pawl 52 which is in engagement with the pawl portion 33*e,* and the first pawl portion 33*c* of the latch member 33 is brought into engagement with the pawl 32, as can be seen from FIG. 15. As a result, the door 99 reaches its fully closed or fully latched condition. Thereafter, the motor 62 is driven in the first direction to return the close output lever 66 to its initial position A as shown in FIG. 6.

Figure 16:
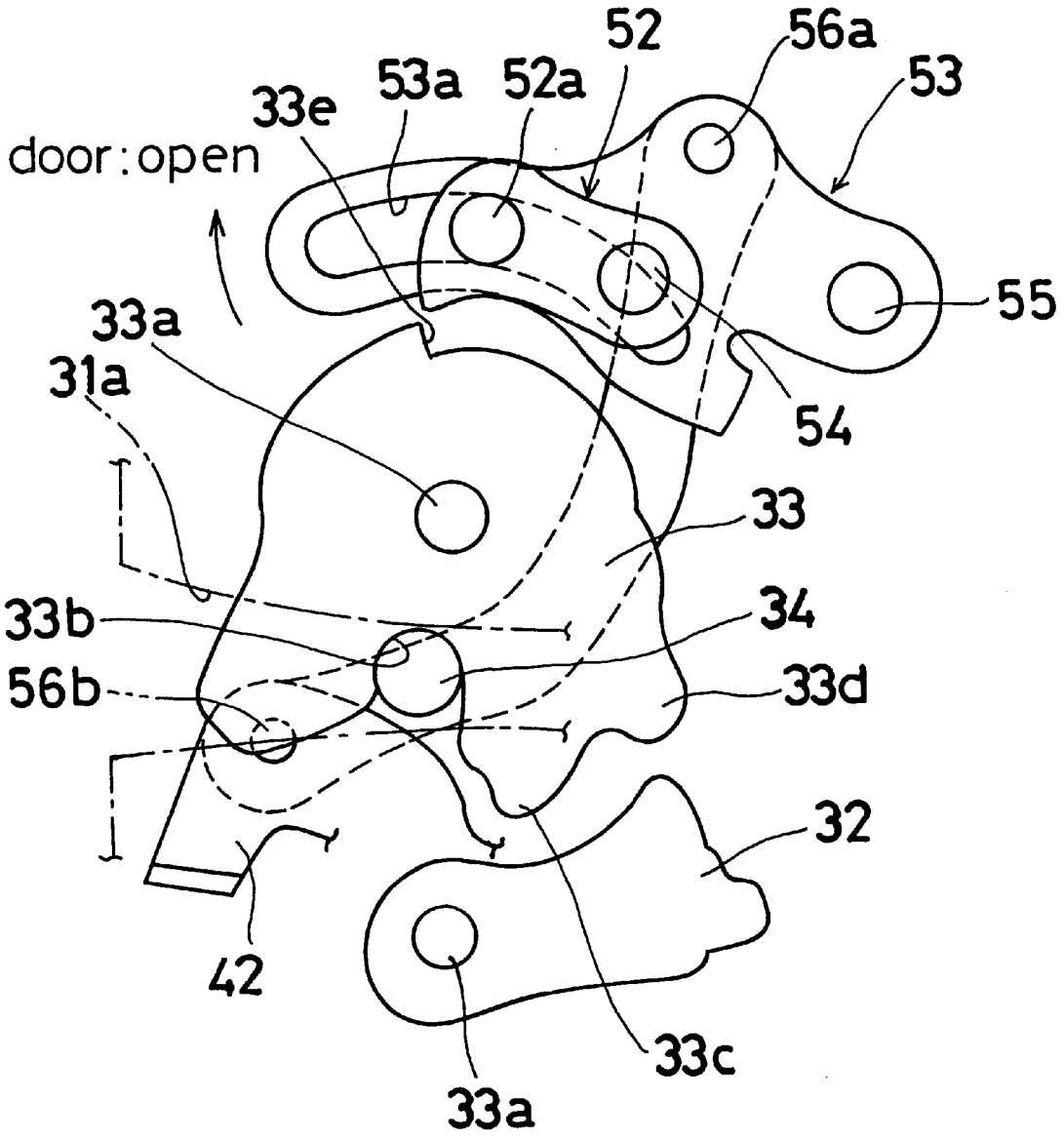
FIG. 16 is a plan view of a portion of the door lock system according to the present invention also illustrating the closing operation.

During rotation of the latch member 33 by the release pawl 52, if the outside handle is manipulated, the open lever 43 is rotated in the door opening direction. The resulting rotation is transmitted via the first slide bush 45 to the second lift lever 42, thereby rotating the second lift lever 42 in the door opening direction. Such rotation of the second lift lever 42 is transmitted via the rod 56 to the cancel lever 53, thereby establishing rotation of the cancel lever 53 in the clockwise direction or the door opening direction in FIG. 16. This brings about a clockwise rotation of the release pawl 52 in FIG. 16 due to the engaging relation between the pin 52*a* of the release pawl 52 and the slot 53*a* of the cancel lever 53, thus releasing the release pawl 52 from the pawl portion 33*a* of the latch member 33. As a result, the door closing operation is interrupted. Also, as can be seen from FIG. 16, if the inside handle is manipulated, the cancel lever 53 is rotated in the door opening direction. This brings about a clockwise rotation of the release pawl 52 in FIG. 13 due to the engaging relation between the pin 52*a* of the release pawl 52 and the slot 53*a* of the cancel lever 53, thus releasing the release pawl 52 from the pawl portion 33*a* of the latch member 33. As a result, the door closing operation is interrupted. Immediately upon interruption of the door closing operation, the motor 62 is driven to return the close output lever 66 to its initial position A.

During engaging movement of the pawl 32 with the first pawl portion 33*c* of the latch member 33, the pawl 32 rotates to ride over the first pawl portion 33*c,*causing the first lift lever 41 to rotate in the door opening direction. Due to the fact that such rotation of the first lift lever 41 is so directed as to be away from the second lift lever 42, the second lever 42 fails to receive the rotation of the first lift lever 41. Thus, no rotation of the cancel lever 53 in the door opening direction is established as a result of the rotation of the second lift lever 42 in the door opening direction. This means that the door closing operation cannot be interrupted or disturbed.

During the locking-and-unlocking operation, the door closing operation and the double locking operation which are each established by the motor 62, the combination of the cam 68 and the close output lever 66, the cam 68 and the locking-and-unlocking output lever 67, and the cam 68 and the close output lever 66 and the locking-and-unlocking output lever 67 are rotated, respectively. However, in the door closing operation, the cam 68 begins to rotate from an angular position above the unlocked position B of the locking-and unlocking output lever 67, resulting in that even though the close output lever 66 rotates during the locking-and-unlocking operation, the door closing operation is never established. In addition, during the door closing operation, despite the continual rotation of the locking-and-unlocking output lever 67, the locking-and-unlocking output lever 67 is positioned at its unlocked position D and the door 99 cannot be brought into its locked condition. The double lock lever 71 fails to rotate due to the fact that its pin 71*a* is in sliding engagement with the groove 68*d* of the cam 68, resulting in the door 99 not being brought into its double locked condition during the door closing operation. Moreover, because in the double locking operation the angular range of the cam 68 is above the locking position A of the locking-and-unlocking lever 67 and the pin 71*a* is engaged with the first cam profile 68*b* of the cam 68, the double locking operation is initiated after establishment of the locked condition of the door 99 under which the locking-and-unlocking lever 67 is at its locked position A. However, during the locking-and-unlocking operation, the double lock output lever 71 fails to rotate, thereby not establishing the double locked condition of the door 99. It is noted that the double lock releasing operation and the door unlocking operation are established concurrently or simultaneously due to the fact that both operations involve substantially the same rotation range of the cam 68.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A door lock system comprising:

a closing mechanism for bringing a door from a half latched condition to a fully latched condition;

a locking-and-unlocking mechanism for bringing the door into a locked condition from an unlocked condition and vice-versa subject to the door being in the fully latched condition;

a double lock mechanism for disabling at least one of an opening of the door and an unlocking operation of the locking-and unlocking mechanism; and a driving mechanism including a common motor for driving the closing mechanism and the double lock mechanism, the driving mechanism including a first output lever linked to the double lock mechanism and movable between a remaining position for disabling operation of the double lock mechanism and a releasing position for enabling operation of the double lock mechanism, a second output lever linked to the closing mechanism and movable from an initial position to an operation position for bringing the door from the half latched condition to the full latched condition, and a rotation member for rotating both the first output lever and the second output lever.

2. A door lock system as set forth in claim 1, wherein the rotation member supports the second output lever for unitary rotation of the rotation member and the second output lever, and rotates the first output lever when engaged therewith.

3. A door lock system as set forth in claim 1, wherein the rotation member is formed with a first cam surface and a second cam surface which are angularly displaced from each other such that the first cam surface is engageable with the first output lever when the first output lever is in the releasing position and the second cam surface is engageable with the first output lever when the first output lever is in the maintaining position.

4. A door lock system comprising:

a closing mechanism for bringing a door from a half latched condition to a fully latched condition;

a locking-and-unlocking mechanism for bringing the door into a locked condition from an unlocked condition and vice-versa subject to the door being in the fully latched condition;

a double lock mechanism for disabling at least one of an opening of the door and an unlocking operation of the locking-and unlocking mechanism; and a driving mechanism driving the locking-and-unlocking mechanism and including a common motor for driving the closing mechanism and the double lock mechanism, the driving mechanism also including a first-output lever linked to the double lock mechanism and movable between a remaining position for disabling operation of the double lock mechanism and a releasing position enabling operation of the double lock mechanism, and a second output lever linked to the closing mechanism and movable from an initial position to an operation position to bring the door from the half latched condition to the full latched condition, a third output lever linked to the locking-and-unlocking mechanism and movable between a locking position to bring the door into the locked condition of the door and an unlocking position to bring the door into the unlocked condition of the door, and a rotation member for rotating the first output lever, the second output lever, and the third output lever.

5. A door lock system as set forth in claim 4, wherein the rotation member supports the second output lever for unitary rotation of the rotation member and the second output lever, said rotation member rotating the third output lever upon engagement of the third output lever and the rotation member.

6. A door lock system as set forth in claim 5, wherein the rotation member is formed with a first cam surface engageable with the first output lever at the releasing position of the first output lever, a second cam surface angularly displaced from the first cam surface and engageable with the first output lever at the maintaining position of the first output lever, and a U-shaped groove adapted to be engaged with and move out of engagement with the third output lever.

* * * * *